US006527421B1

(12) United States Patent
Qing

(10) Patent No.: US 6,527,421 B1
(45) Date of Patent: Mar. 4, 2003

(54) LAMPSHADE FRAME WITH SEGMENTED RIBS TO ACHIEVE BOTH AN ERECT AND COLLAPSED STATE

(75) Inventor: He Hong Qing, Zhongshan (CN)

(73) Assignee: Berman Industries, Inc., Chicago, IL (US)

( * ) Notice: Subject to any disclaimer, the term of this patent is extended or adjusted under 35 U.S.C. 154(b) by 0 days.

(21) Appl. No.: 10/033,821

(22) Filed: Dec. 20, 2001

(51) Int. Cl.[7] ..... F21V 1/06

(52) U.S. Cl. ..... 362/352; 362/356; 362/357; 362/358; 362/434; 362/450

(58) Field of Search ..... 362/352, 353, 362/354, 355, 356, 357, 358, 360, 361, 330, 434, 450

(56) References Cited

U.S. PATENT DOCUMENTS

| | | | | | |
|---|---|---|---|---|---|
| 427,661 | A | * | 5/1890 | Berg | 362/450 |
| 2,884,515 | A | * | 4/1959 | Fogel | 362/352 |
| 3,023,307 | A | * | 2/1962 | Okamoto | 362/352 |
| 4,290,099 | A | | 9/1981 | Vicars-Harris | |
| 4,354,222 | A | * | 10/1982 | Gall | 362/352 |
| 4,714,987 | A | | 12/1987 | Dene | |
| 4,772,992 | A | | 9/1988 | Tang | |
| D332,840 | S | | 1/1993 | Cohon | |
| 5,222,806 | A | | 6/1993 | Roberts, III | |
| D340,302 | S | | 10/1993 | Roberts, III | |
| D340,537 | S | | 10/1993 | Roberts, III | |
| D348,324 | S | | 6/1994 | Parks | |
| 5,375,048 | A | | 12/1994 | Barnes | |
| D355,725 | S | | 2/1995 | Roberts, III | |
| D360,275 | S | | 7/1995 | Roberts, III | |
| D360,277 | S | | 7/1995 | Roberts, III | |
| D373,006 | S | | 8/1996 | Chelsea | |
| D373,007 | S | | 8/1996 | Chelsea | |
| D377,401 | S | | 1/1997 | Chelsea | |
| D378,145 | S | | 2/1997 | Cohon | |
| 5,632,460 | A | | 5/1997 | Strickland | |
| 5,649,764 | A | | 7/1997 | Strickland | |
| 5,868,492 | A | | 2/1999 | Strickland | |
| 5,868,493 | A | | 2/1999 | Winkelhake | |
| D435,140 | S | | 12/2000 | Silver | |
| D438,668 | S | | 3/2001 | Silver | |
| 6,315,434 | B1 | | 11/2001 | Long | |

* cited by examiner

*Primary Examiner*—Sandra O'Shea
*Assistant Examiner*—Ronald E. DelGizzi
(74) *Attorney, Agent, or Firm*—Fitch, Even, Tabin & Flannery

(57) ABSTRACT

There is provided a lampshade frame that shifts between an erect, use configuration and a collapsed configuration for shipping, packaging and/or storage. The frame includes an upper hoop and a lower hoop with segmented ribs extending between the hoops. Each of the segmented ribs includes at least two segments that are interconnected by a sleeve that allows them to shift between an extended position, where the length of the rib is maximized for erecting the lampshade, and a retraced state, where the length of the rib is shortened for collapsing the lampshade. The sleeve also locks the ribs in the extended state against unintentional collapse of the lampshade frame.

16 Claims, 5 Drawing Sheets

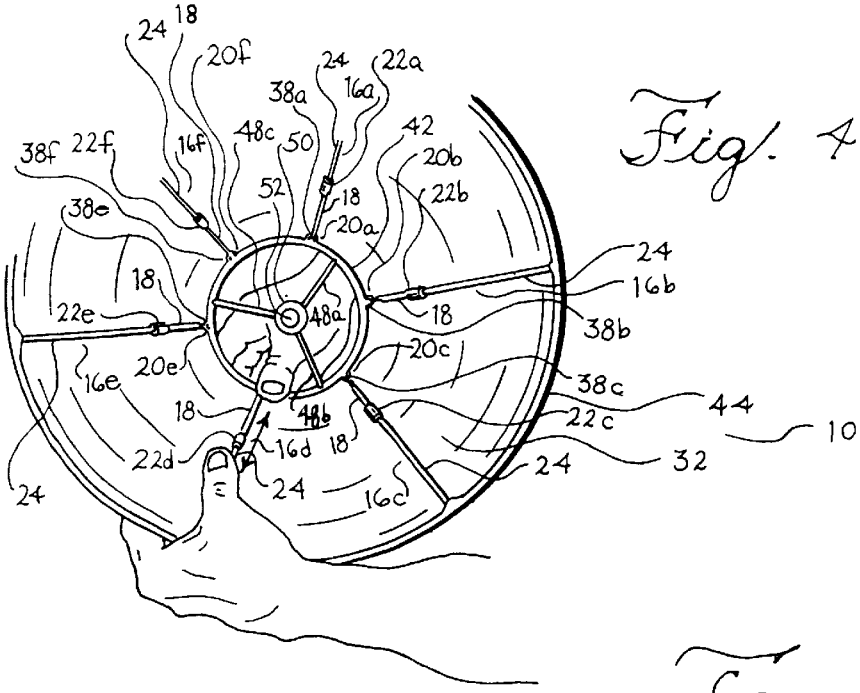
Fig. 4c
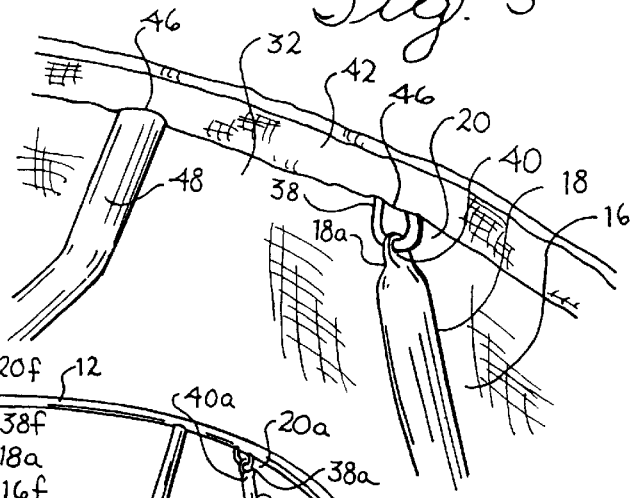
Fig. 5
Fig. 6
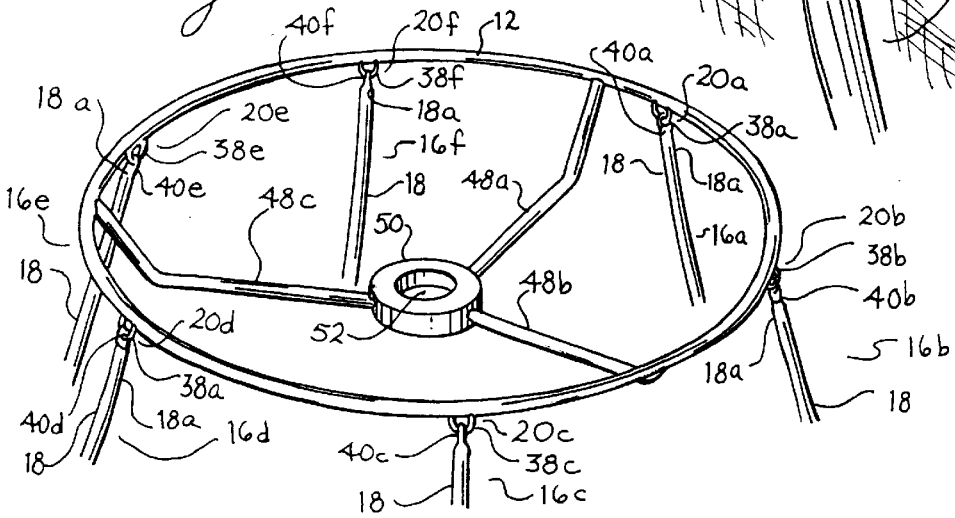

LAMPSHADE FRAME WITH SEGMENTED RIBS TO ACHIEVE BOTH AN ERECT AND COLLAPSED STATE

FIELD OF THE INVENTION

The present invention relates generally to lampshades and, more particularly, to a lampshade frame with segmented ribs that shift relative to one another to achieve both an erect state and a collapsed state.

BACKGROUND OF THE INVENTION

The need for collapsible lampshades stems from the fact that it is more cost effective to store and ship lampshades if they are flat than when they are erect because this reduces the amount of space that these lampshades require during shipment. In addition, shipping a lampshade in the collapsed position minimizes the chance of damage to the lampshade. Accordingly, there have been a number of collapsible lampshades in the prior art that have been developed to satisfy this need. However, these solutions have been unsatisfactory for several reasons.

One prior solution to this problems is disclosed by U.S. Pat. No. 5,375,048 to Barnes. This patent shows a collapsible lampshade that has a number of ribs extending directly between the upper and lower hoops. These ribs are rotatably attached to the top and bottom hoops and are articulated with a pivot at about the middle of each rib. The central hub actuates a slide that locks the pivot of each rib to form the lampshade. This solution has two problems with it. First, this design includes many more parts than a conventional lampshade which increases the cost of the lampshade. Second, the position of the central hub is too low for the lampshade to fit properly with some lamps.

Other prior solutions including those show in U.S. Pat. No. 4,354,222 to Gall, U.S. Pat. No. 4,290,099 to Vicars-Harris, and U.S. Pat. No. 3,764,801 to Mainieks have multiple parts that need to be assembled by the end user. This can be time consuming and can frustrate the end user. Accordingly, there exists a need for a collapsible lampshade that is one piece, that is cost effective, and that is simple for the end user to erect and attach to a lamp.

SUMMARY OF THE INVENTION

The present invention pertains to a lampshade frame that can be shifted between an erect state for use and a collapsed state for shipping, packaging and/or storage. A lampshade frame in accordance with the present invention includes an upper hoop, a lower hoop and at least one segmented rib extending between and pivotally attached to the upper and lower hoops. The at least one segmented rib has at least a first segment and a second segment. The segments are capable of shifting relative to one another between and an extended state to hold the lampshade frame erect and a retracted state relative to one another to allow the lampshade frame to collapse. A sleeve interconnects the first and second segments and aids in locking the segments in the extended state against unintentional movement to maintain the lampshade frame erect and upon selective activation allows the segments to move relative to another to retract and collapse the lampshade frame.

The sleeve may be fixed relative to the first segment and may surround at least a portion of the second segment. The second segment also may have a notch that receives a portion of the sleeve to lock the segments in the extended state to maintain the lampshade frame erect. The second segment may also be capable of sliding through the sleeve when the segments are being shifted between the extended and retracted states.

The segments further maybe capable of pivoting at the hoops when the segments are being shifted between the extended and retracted states. In addition, the segments in the extended state may create an inward biasing force which further locks the sleeve into the shelf of the second segment.

The first segment may be pivotally attached to the upper hoop, and the second segment may be pivotally attached to the lower hoop. The upper hoop may also include an upper ring and a lower ring. The lower ring attaches the at least one segmented rib, and the upper ring defines at least one slot to allow the at least one segmented rib to pivot. The at least one segmented rib may be a plurality of segmented ribs.

The upper hoop may further includes a hub for mounting the lampshade and at least one spider member extending between the upper hoop and the hub. The at least one spider may include a plurality of spider members. Each of the plurality of spider members may extend downward and inward toward the hub to position the hub below the upper hoop.

The lampshade frame may further comprise a cover that extends between the upper and lower hoops. The cover may define holes whereby the segmented ribs and spider arms can extend through the cover to attach to the upper and lower hoops. The cover also may be capable of engaging the second segment of the segmented rib, thereby aiding the notch in receiving a portion of the sleeve when in the elongated state. In addition, there may be an internal liner that covers the segmented ribs. This liner may be a predetermined size large enough so that it does not interfere with the movement of the upper hoop, lower hoop, and segmented ribs.

Also in accordance with the present invention is a method of erecting a lampshade. The method of erecting a lampshade from a collapsed state includes the step of providing a lampshade frame having an upper hoop, a lower hoop and a plurality of segmented ribs extending between the upper and lower hoops. Each of the segmented ribs has at least two rib segments being interconnected by a sleeve that allows the ribs segments to move relative to one another. Finally, a shade cover extends between the upper and lower hoops and over the segmented ribs. To erect this lampshade, one moves the upper hoop and the lower hoop with a constant action in opposite directions to one another. Once the hoops are moved as far apart as the shade cover allows, the sleeve is designed to lock each of the segmented ribs in an extended state. More specifically, for example, to lock the segmented ribs in an extended state relative to one another with the sleeves, each of the sleeves may be fixed relative to one of the segmented ribs and the other of the segmented ribs may slide through the sleeve so that a notch-like construction may engage the sleeve to form a locking engagement.

BRIEF DESCRIPTION OF THE DRAWINGS

FIG. 4*c* is an enlarged perspective view of the lampshade frame of FIG. 2 showing a user erecting or collapsing the lampshade frame depending on the direction (see arrows);

FIG. 5 is an enlarged, partial perspective view of the lampshade frame of FIG. 2 with the internal liner omitted to show a few of the holes through the cover that allow attachment of the spider arms and rib segments to the upper hoop;

FIG. 6 is an enlarged, partial perspective view of the lampshade frame of FIG. 1 showing the upper hoop, spider arms, central hub and rib segments;

DESCRIPTION OF THE PREFERRED EMBODIMENT

Figure 1:
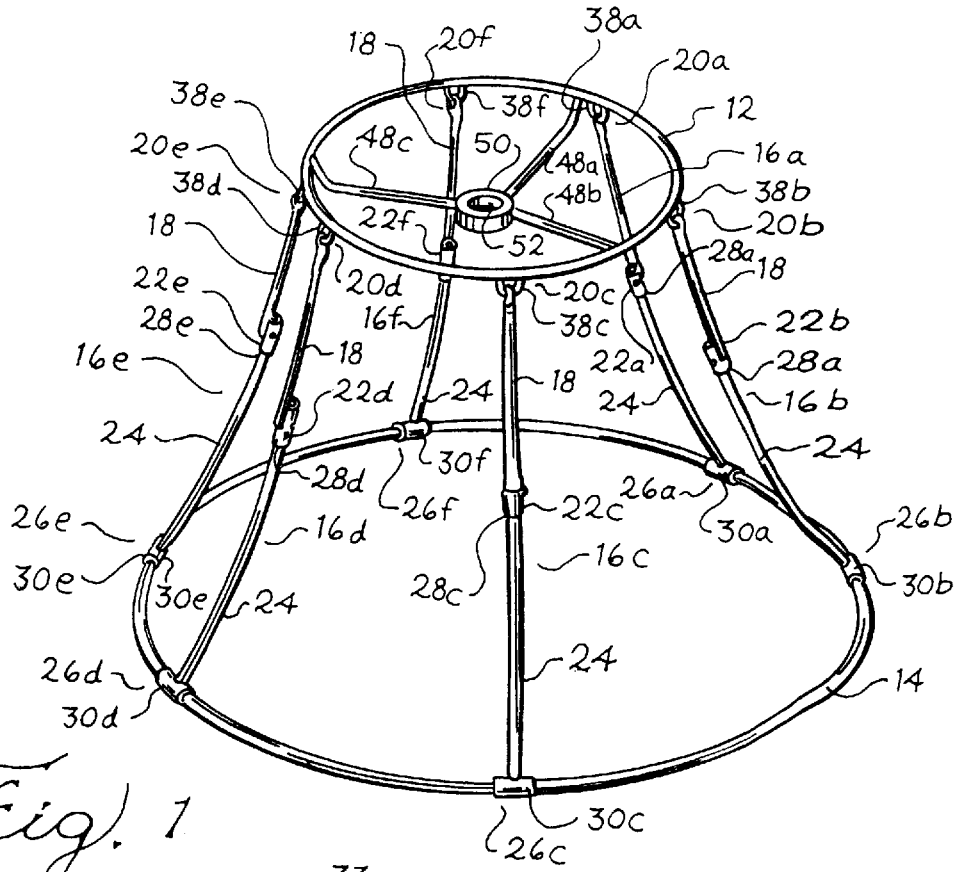
FIG. 1 is a perspective view of a lampshade frame having segmented ribs with sleeves that lock the rib segments in the erect state and allow the rib segments to shift to achieve the collapsed state.
Figure 2:
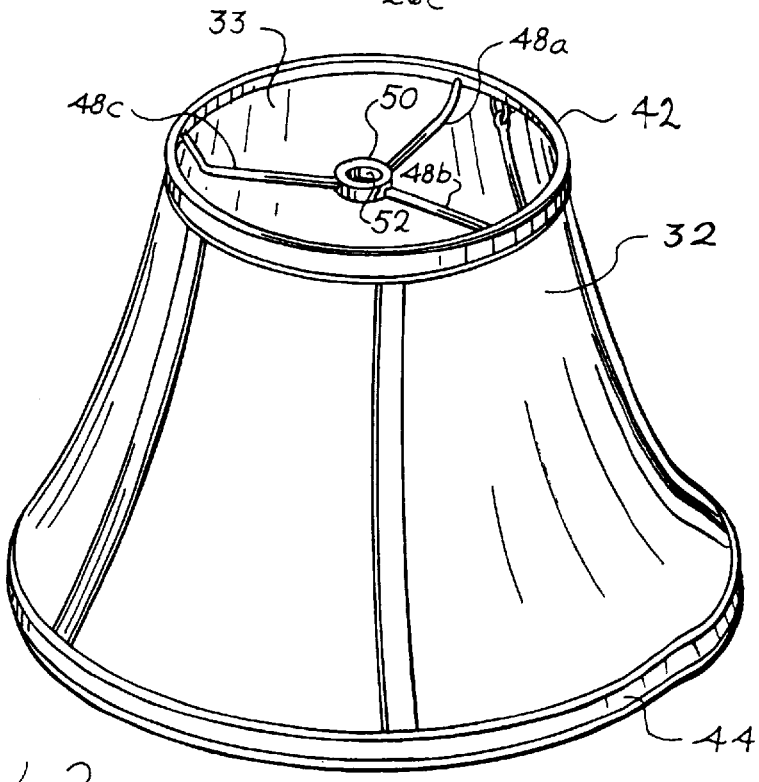
FIG. 2 is perspective view of the lampshade frame of FIG. 1 with a shade cover and an internal liner covering the segmented ribs.
Figure 8:
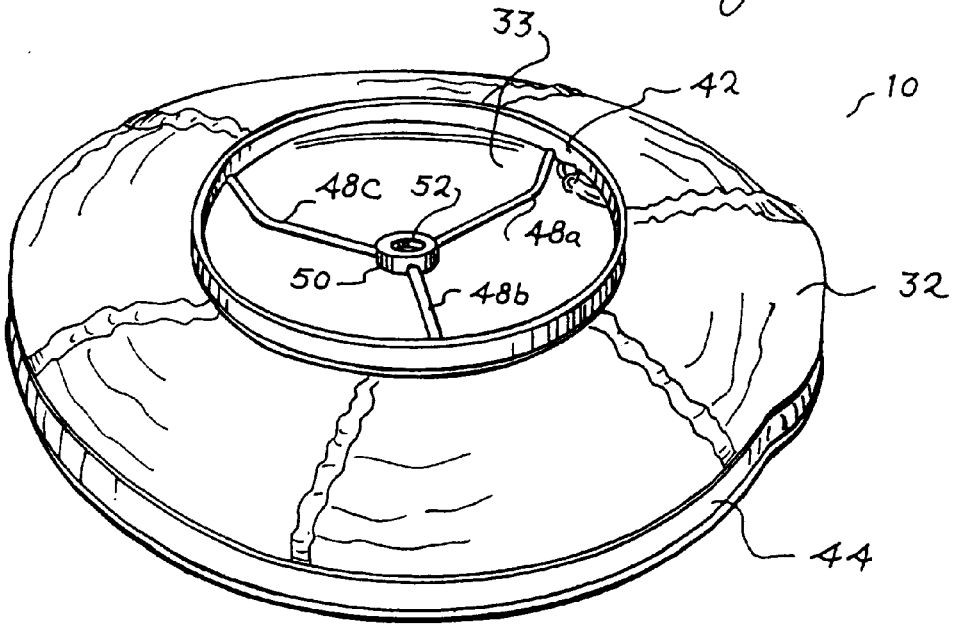
FIG. 8 is a perspective view of the lampshade frame of FIG. 2 in the collapsed state.

Referring to FIG. 1, the present invention is embodied in a lampshade frame 10 that can be easily erected and collapsed for effective and efficient packaging and/and or storage (see also FIGS. 2 and 8). The frame 10 includes in general an upper hoop 12 and a lower hoop 14, each of which preferably has a circular cross-section and defines a circular perimeter. Ribs segmented 16 into an upper segment 18 and lower segment 24 extend between the upper and lower hoops 12 and 14. The upper segment 18 pivotally attaches to the upper hoop 12, and the lower segment 24 also pivotally attaches to the lower hoop 14. A sleeve 22 interconnects the upper and lower segments 18 and 24 and allows the segments 18 and 24 to shift relative to one another between an a fully extended state (FIG. 1) when the frame 10 is completely erect and a fully retracted state (FIG. 8) when the frame 10 is collapsed. In the erect state, each sleeve 22 cooperates with a notch in one of the segmented ribs 16 to lock the segments 18 and 24 against unintentional movement. More specifically, the hollow sleeve 22 is fixed to one of rib segment and its surrounds the other.

The number of segmented ribs 16 generally depends on the overall size of the lampshade frame. The larger the lampshade frame, then the number of segmented ribs would typically increase. For example, where the upper hoop has a diameter of approximately 4 inches and the lower hoops has a diameter of approximately 11 inches, the preferred number of segmented ribs is six, as illustrated in FIG. 1. The segmented ribs, as wells as the other components, i.e., the hoops, sleeves, etc., may be made of any material of suitable rigidity, such as metals and plastics, that can support a lampshade cover and are tolerant of the heat generated by conventional light bulbs.

A shade cover 32 also extends between the upper and lower hoops 12 and 14. With respect to the illustrated lampshade frame 10, since the upper hoop 12 is smaller in diameter than the lower hoop 14, the shade cover 32 takes a conical or frustoconical shape, enhancing the cosmetic appeal of the lampshade 10 (see FIG. 2).

Figure 4A:
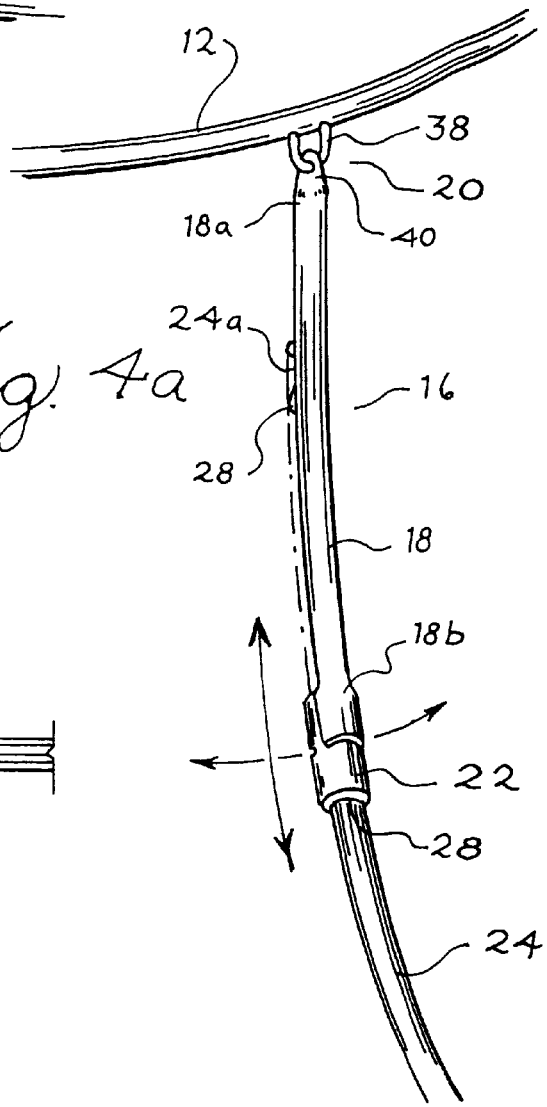
FIG. 4*a* is an enlarged, partial perspective view of the lampshade frame of FIG. 1 showing the sleeve and notch engagement between rib segments.

More specifically, with each segmented rib 16, the upper segment 18 has an upper end 18*a* and a lower end 18*b*. As illustrated in FIG. 4*a*, the sleeve 22 is fixed permanently to the lower end 18*b* with any suitable method of attachment, such as by welding or a secure type of glue. The preferred lower end 18*b* is configured to provide sufficient surface for the attachment of the sleeve 22. For example, it could be flattened or configured, as illustrated in FIG. 4*a*, to match the profile of the outer surface of the sleeve. The sleeve is mounted on the inward side (toward the center of frame) of the lower end 18*a* of the upper segment 18.

Figure 4B:
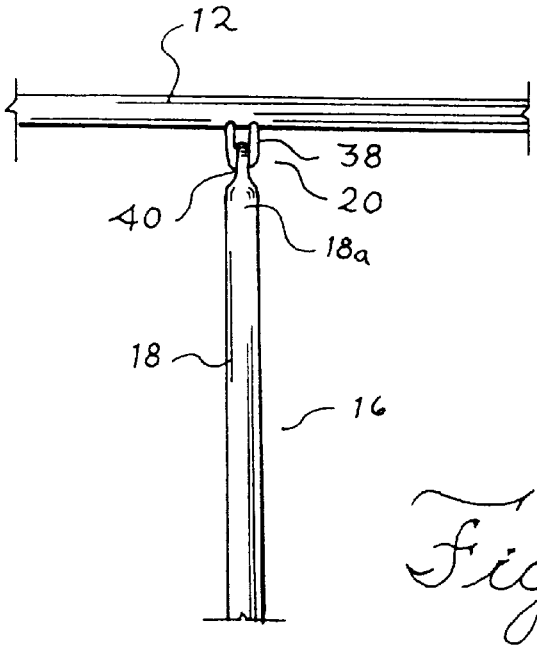
FIG. 4*b* is an enlarged, partial elevational view of the lampshade frame of FIG. 1 showing the pivotal connection between a rib segment and the upper hoop.

Referring to FIG. 4*b*, a pivotal connection 20 affixes the upper end 18*a* of each upper rib segment 18 to the upper hoop 12. The pivotal connection 20 includes a ring 38 that extends downward from the upper hoop 12. The ring can be glued or welded on to the upper hoop 12. The upper end 18*a* of the upper rib segment 18 defines a hole 40 through which the ring 38 passes. To facilitate pivoting, the upper end 18*a* is preferably flattened at the hole, this also enables the ring 38 to be narrow and more elongated to restrict lateral movement at the pivotal attachment 20.

Figure 3:
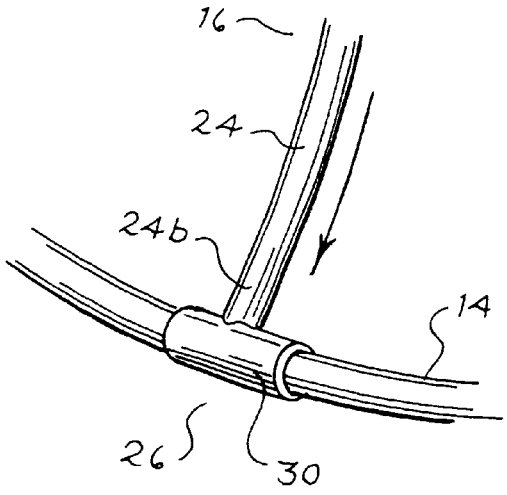
FIG. 3 is an enlarged, partial perspective view of the lampshade frame of FIG. 1 showing the pivotal connection between a rib segment and the lower hoop.

Referring the FIGS. 3 and 4*a*, the lower rib segment 24 includes an upper end 24*a* and a lower end 24*b*. A second pivotal connection 26 affixes the lower end 24*b* to the lower hoop 14. The second pivotal connection 26 includes a short tube or sleeve-like structure 30 that is affixed on and generally perpendicular to the lower end 24*b*. The tube 30 may be affixed in a suitable manner, such as by a weld or glue. The tube 30 encompasses the circular cross-section of the lower hoop 14. Because of the radius of curvature of the lower hoop 14, the tube 30 is relatively short, such as, for example, when compared to the interconnecting sleeve 22.

As illustrated in FIG. 4*a*, the lower rib segment 24 extends through the sleeve 22. The sleeve 22 enables the lower rib segment 24 to be shifted relative to the upper rib segment 18 to change the effective length of the rib between an expanded state (as shown in solid lines) and a retracted state (as shown in dashed lines). More specifically, a user simply needs to move the upper and lower hoops 12 and 14 toward one another to retract the segmented ribs 16 to their shortest length to collapse the lampshade frame 10 and away from one another to extend the segmented ribs 16 to their maximums length to achieve the erect state for the lampshade frame 10. The pivotal connections 20 at the upper hoop 12 enable the upper segments 18 to pivot outward when shifting to the collapse state and inward when shifting to the erect state. Similarly, the pivotal connections 26 at the lower hoop 14 enable the lower segments 24 to pivot inward when shifting to the collapse state and outward when shifting to the erect state.

Each sleeve also serves in locking the segmented ribs in their extended state to maintain the lampshade frame in the erect state against unintentionally collapse. That is, to erect the lampshade, a user simply needs to move the hoops 12 and 14 in opposite directions away from each other to lock the segmented ribs. It is preferred that this movement be a single constant action to erect the lampshade with no other assembly, such as interconnecting additional parts. This facilitates quick set-up of the lampshade for use.

More specifically, the lower edge of the sleeve 22 is received in a notch 28 defined by the outer side of the upper end 24*a* of the lower segment 24. This engagement occurs when the lower end 24*a* is brought into the sleeve 22 to maximize the length of the segmented rib 16. To further facilitate this locking engagement, the rib segments 18 and 24 are bowed inward slightly to create a biasing effect that tends to force the lower edge of the sleeve 22 into the notch 28. In other words, this inward movement is created by the shape of the segmented rib 16, which is slightly bowed to accommodate the frustoconical shape of the shade cover 32, which in turn, forces the hollow sleeve 22 to press on the surface of the upper end portion 24*a* that faces toward the outside of the lampshade frame 10 until it reaches the notch 28, which also faces toward the outside of the lampshade 10. It then snaps into the notch 28. In the erected state, the tension of the shade cover 32 being stretched between the upper and lower hoops 12 and 14 also provides generally uniform pressure on the segmented ribs, thereby aiding in maintaining the lower edge of the sleeve in the notch 28. In addition, the shade 32 cover prohibits the upper hoop 12 and lower hoop 14 from being spread too far apart, which prevents the lower segment 24 from being pulled out of the sleeve 22 which would effectively dismantle the lampshade frame 10.

Figure 7:
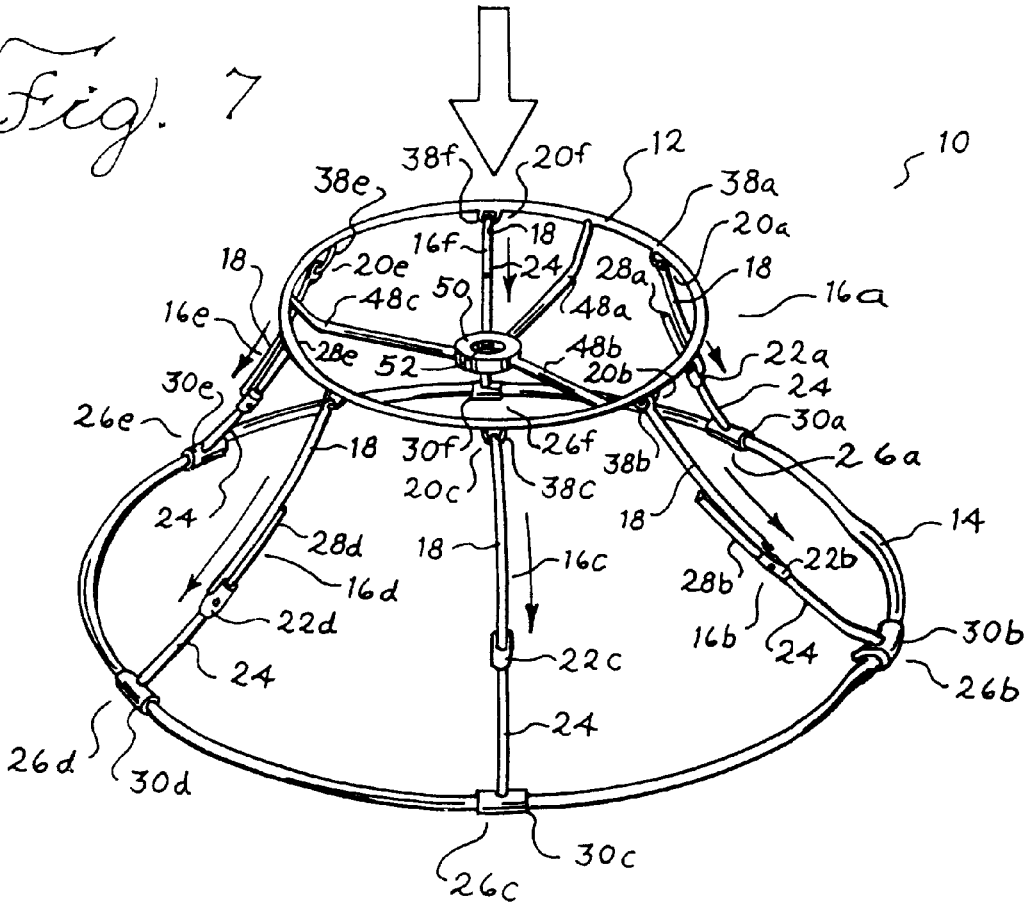
FIG. 7 is a perspective view of the lampshade frame of FIG. 1 showing the operation of the segmented ribs in a collapsing motion.

As illustrated in FIGS. 7 and 8, the user can move the upper hoop 12 and lower hoop 14 toward each other to collapse the lampshade 10. However, before moving the hoops 12 and 14 toward one another, one needs to release the locking engagement between the sleeves 22 and notches 28. This is done by reaching inside the lampshade frame and gently pressing outward on each of the sleeves 22 until they slide off the notches, which causes them to release.

Referring to FIG. 5, a shade cover 32 that is made of cloth or other material is attached to the upper hoop 12 by having its top end 42 encircle the upper hoop 12 where it is sewn or glued to itself and is also attached to the lower hoop 14 by having its lower end 44 encircle the lower hoop 14 where it is also sewn or glued to itself. There are also holes 46 cut into the shade cover 32 through which the spider members 48 and first portion 18 of the segmented ribs 16 extend. These holes 46, located near the lower hoop 14, also allow the segmented ribs 16 to move so that the lampshade 10 may be erected or collapsed without interference from the shade cover 32. Consequently, the shade cover 32 can be attached last of all the components of the lampshade 10. In addition, there also may be an internal liner 33 that may extend between the upper hoop 12 and lower hoop 14 to cover the segmented ribs 16 of the lampshade frame 10. The internal liner 33 may be sufficiently opaque so the segmented ribs 16 cannot be seen by an observer looking through the top or bottom openings of the lampshade. This liner must be large enough so that it allows the upper hoop 12, lower hoop 14, and segmented ribs 16 to move freely without any interference.

Referring now to FIG. 6, three spider members 48 are shown that are attached to the inside of the upper hoop 12 and extend toward the center of the upper hoop 12 where they are attached to the central hub 50. These spider members 48 are capable of suitably transferring the weight of the lampshade 10 to the central hub 50 which has a hole 52 in its center for receiving a screw (not shown) from a lamp (not shown) upon which a nut (not shown) is screwed, thereby securing the lampshade frame 10 to a lamp. Since the central hub 50 is only near the top of the lampshade 10 and the spider members 48 bend down from the upper hoop 12, this attachment can be satisfactorily hidden from view, thereby increasing the cosmetic appeal of the lampshade 10. Further, any number of spider members may be employed, especially depending on the size of the lampshade and/or the shape of the lampshade. For example, the larger the lampshade, then the more spider members would generally be used. In addition, for square cross-sectioned lampshades, four spider members are generally used.

Figure 9:
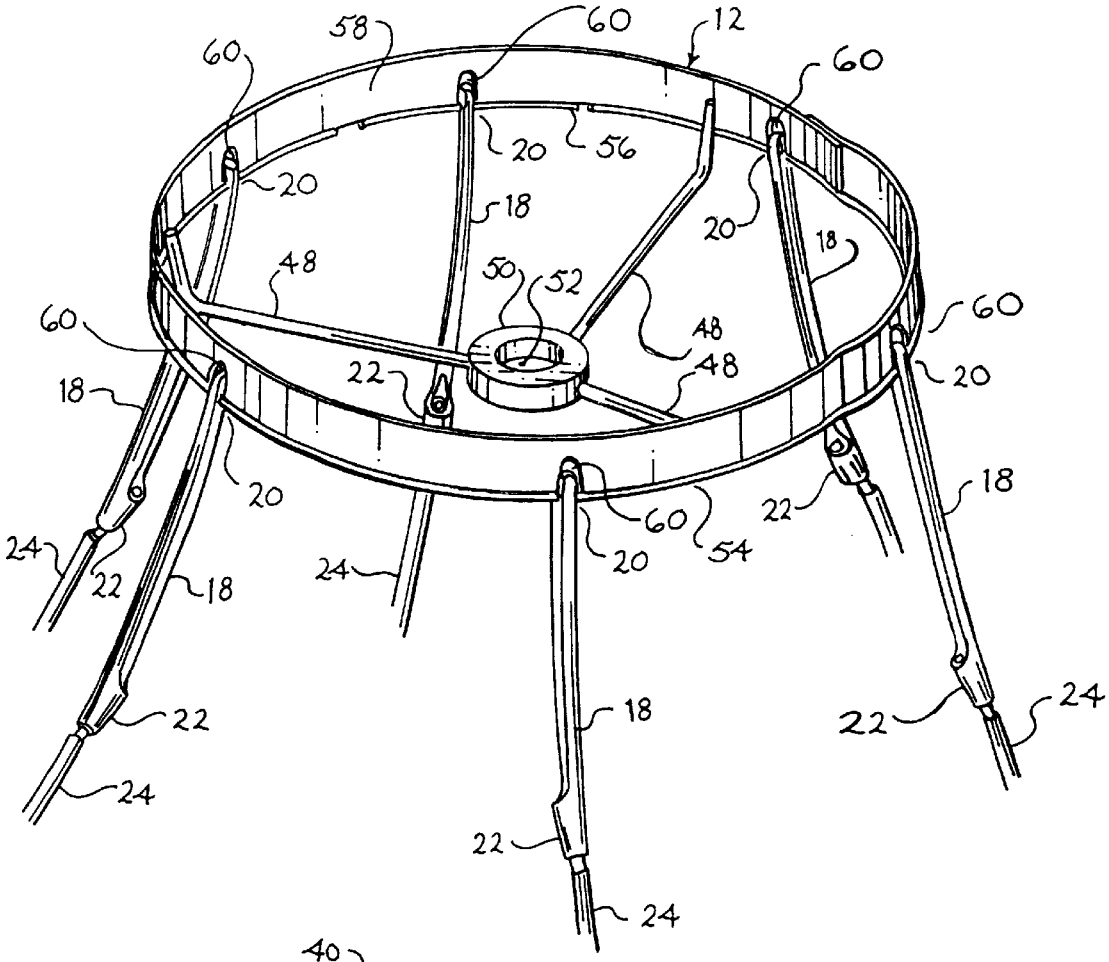
FIG. 9 is an enlarged, partial perspective view of a lampshade with an alternate construction compared to the lampshade of FIG. 1.
Figure 10:
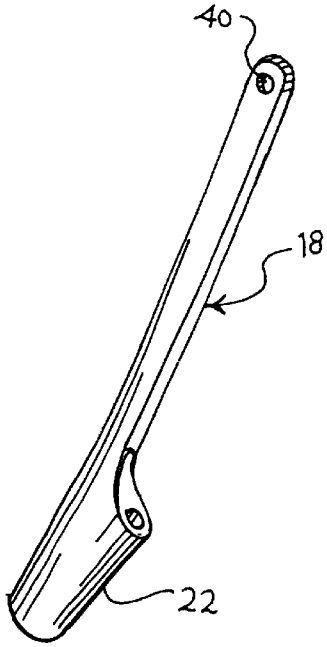
FIG. 10 is a perspective view of the upper segment of the lampshade of FIG. 9.

Referring to FIGS. 9 and 10, there is illustrated an alternate embodiment of a lampshade frame. The alternate lampshade frame 110 includes an upper hoop 112 and a number of segmented ribs 116, each with an upper rib segment 118 and a lower rib segment 124.

More specifically, the upper hoop 112 includes a ring 154 with a circular cross-section. The ring 154 is made up of two arcuate segments 154*a*, 154*b*. The first arcuate segment 154 extends less than, but over a majority of, the three hundred sixty degrees of a circle. The second arcuate segment 154*b* extends the remainder of the circle. There may be breaks between the first and second segments 154*a*, 154*b*.

The upper hoop 112 also includes a circular band 158 with a rectangular cross-section. The ring 154 attaches to the bottom edge of the band 158. The band 158 includes a series of vertical slots 160, wherein each slot 160 is employed in attaching one of the segmented ribs 116 by way of the upper segment 118. That is, the upper end of each upper rib segment 118 includes a hole 140. The ring 154 threads through the hole to attach the rib 116 to the upper hoop 112. The slot 160 allows the upper end room to pivot as the shade is shifted between the erect and collapsed state.

The upper hoop 112 and the attachment of the segmented ribs 116 is done in the following general manner. First, the first arcuate segment 154*a* of the ring 154 is threaded through the hole 140 of all but one of the upper ribs segments 118. The circular band 158 is then placed on top of the first arcuate segment 154*a* with the upper rib segments 118 spaced so that they each line up with one of the slots 160. The circular band 158 is then glued, welded or otherwise secured to the first arcuate segment 154. The first arcuate segment 154*a* and the slots 160 allow each of the segmented ribs 116 to pivot freely. The slots 160 also maintain the circumferential spacing between each of the segmented ribs 116.

Second, the second arcuate segment 154*b* of the ring 154 is threaded through the hole 140 of the upper rib segment 118 of the remaining segmented rib 116. Then, the second arcuate segment 154 is mated with the circular band 158 with the upper end of the upper rib segment 118 aligned with the remaining slot 160. The second arcuate segment 154*b* and the circular band 158 are secured together by gluing, welding or other attachment method.

This embodiment of the lampshade frame 110 has the advantage of being easily and cost-effectively manufactured and assembled. For example, in addition to the assembly steps described above, the upper rib segments 118 can be manufactured from plastics and can be made using a plastic injection molding process, which is cost advantageous. Thus, for example, the sleeve 122 can be molded integral with the upper rib segment 118. In addition the lower rib segments 124 could also be manufactured from plastics and made using a plastic injection molding process. The notch 128 of the lower rib segment 124 would be molded integral therewith. Otherwise, the operation and structure of this embodiment is similar to that of the previously described lampshade frame 10.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is not intended that the invention be limited to the particular embodiments illustrated by the drawings and described in the specification as the best modes presently contemplated for carrying out this invention, but that the invention will include any embodiments falling within the description of the appended claims.

What is claimed is:

1. A lampshade frame that is capable of shifting between an erect configuration and a collapsed configuration comprising:

an upper hoop;

a lower hoop;

at least one segmented rib extending between and pivotally attached to the upper and lower hoops and having at least a first segment and a second segment, the segments being capable of shifting relative to one another and having ends adjacent to one another when shifted to an extended state to set the lampshade frame in the erect configuration for use and spaced from one another when shifted to a retracted state to set the lampshade frame in the collapsed configuration;

a sleeve interconnecting the first and second segments, the sleeve allows the segments to shift relative to one another and locks the ends of the segments to maintain the segments in the extended state against unintentional movement and upon selective activation allows the adjacent ends to space from one another so that the segments move alongside one another to retract and collapse the lampshade frame.

2. The lampshade frame of claim 1 wherein the sleeve is fixed relative to the first segment and surrounds at least a portion of the second segment and the second segment has a notch that receives a portion of the sleeve to lock the segments in the extended state to erect the lampshade frame.

3. The lampshade frame of claim 2 wherein the second segment is capable of sliding through the sleeve when the segments are being shifted between the extended and retracted states.

4. The lampshade frame of claim 3 wherein the segments are capable of pivoting at the hoops when the segments are being shifted between the extended and retracted states.

5. The lampshade frame of claim 4 wherein the segments in the extended state create an inward biasing force which further locks the sleeve into the notch of the second segment.

6. The lampshade frame of claim 5 wherein the first segment is pivotally attached to the upper hoop and the second segment is pivotally attached to the lower hoop.

7. The lampshade from of claim 6 wherein the upper hoop further comprises an upper ring and a lower ring, the lower ring attaching the at least one segmented rib and upper ring defining at least one slot to allow the at least one segmented rib to pivot.

8. The lampshade frame of claim 7 wherein the at least one segmented rib further comprises a plurality of segmented ribs.

9. The lampshade frame of claim 8 wherein the upper hoop further comprises a hub for mounting the lampshade frame to a lamp and at least one spider member extending between the upper hoop and the hub.

10. The lampshade frame of claim 9 wherein the at least one spider member comprises a plurality of spider members, each of the plurality of spider members extending downward and inward toward the hub to position the hub below the upper hoop.

11. The lampshade frame of claim 10 further comprises a cover that extends between the upper and lower hoops.

12. The lampshade frame of claim 11 wherein the cover defines holes whereby the segmented ribs and spider arms can extend through the cover to attach to the upper and lower hoops.

13. The lampshade frame of claim 12 wherein the cover is capable of engaging the second segment of the segmented rib thereby aiding the notch in receiving a portion of the sleeve when in the elongated state.

14. The lampshade frame of claim 13 which further comprises an internal liner that covers the segmented ribs and that is of a predetermined size so as not to inhibit the movement of the upper hoop, lower hoop, or segmented ribs.

15. The method of erecting a lampshade from a collapsed state comprising:

providing a lampshade frame having an upper hoop, a lower hoop, a plurality of segmented ribs extending between the upper and lower hoops, each of the segmented ribs having at least two rib segments being interconnected by a sleeve that allows the ribs segments to move relative to one another, and a shade cover extending between the upper and lower hoops and over the segmented ribs; and moving the upper hoop and the lower hoop with a constant action in opposite directions to one another to lock the segmented ribs in an extended state relative to one another with the sleeves and so that the shade cover interposed between the upper hoop and the lower hoop is stretched between the hoops for use.

16. The method of claim 15 wherein, to lock the segmented ribs in an extended state relative to one another with the sleeves, each of the sleeves is fixed relative to one of the segmented ribs and the other of the segmented ribs slides through the sleeve so that a notch-like construction engages the sleeve to form a locking engagement.

* * * * *